US010400772B2

(12) United States Patent
Sun

(10) Patent No.: US 10,400,772 B2
(45) Date of Patent: Sep. 3, 2019

(54) SCROLL COMPRESSOR HAVING VALVE COMPONENT ARRANGED IN PASSAGE OF BACK PRESSURE CAVITY AND PROVIDING OPENINGS FOR PASSAGE OF FLUID

(71) Applicant: Emerson Climate Technologies (Suzhou) Co., Ltd., Jiangsu (CN)

(72) Inventor: Qingfeng Sun, Jiangsu (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 606 days.

(21) Appl. No.: 14/910,503

(22) PCT Filed: Jul. 16, 2014

(86) PCT No.: PCT/CN2014/082316
§ 371 (c)(1),
(2) Date: Feb. 5, 2016

(87) PCT Pub. No.: WO2015/018268
PCT Pub. Date: Feb. 12, 2015

(65) Prior Publication Data

US 2016/0177953 A1 Jun. 23, 2016

(30) Foreign Application Priority Data

Aug. 7, 2013 (CN) ..... 2013 1 0342191
Aug. 7, 2013 (CN) ..... 2013 2 0481483 U

(51) Int. Cl.
*F04C 29/12* (2006.01)
*F04C 18/02* (2006.01)
(Continued)

(52) U.S. Cl.
CPC ..... *F04C 29/128* (2013.01); *F04C 18/0215* (2013.01); *F04C 18/0261* (2013.01); *F04C 27/005* (2013.01); *F04C 28/24* (2013.01)

(58) Field of Classification Search
CPC ..... F04C 18/0215; F04C 18/0261; F04C 29/128; F04C 27/005; F04C 28/24; F04C 28/26; F04C 23/008
(Continued)

(56) References Cited

U.S. PATENT DOCUMENTS 6,102,682 A 8/2000 Kim
2015/0176585 A1* 6/2015 Sun ..... F04C 28/24 418/55.4

FOREIGN PATENT DOCUMENTS

CN 1232927 A 10/1999
CN 1670372 A 9/2005
(Continued)

OTHER PUBLICATIONS

Machine Translation JP 2008-280847 Done Mar. 30, 2018.*
(Continued)

*Primary Examiner* — Mary Davis
*Assistant Examiner* — Dapinder Singh
(74) *Attorney, Agent, or Firm* — Harness, Dickey & Pierce, P.L.C.

(57) ABSTRACT

The present invention relates to a scroll compressor (100). The scroll compressor comprises a shell (10); a fixed scroll component (80) and a moving scroll component (70) arranged in the shell, wherein the fixed scroll component is fixed relative to the shell, and the moving scroll component can float in the axial direction relative to the fixed scroll component; a main bearing base (40) is arranged in the shell to support the moving scroll component, a back pressure cavity (B) is formed between the moving scroll component and the main bearing base and communicated with fluid of a compression cavity (C2) through a communication channel (73), the communication channel (73) is formed in the moving scroll component, and the compression cavity (C2)
(Continued)

is formed between the fixed scroll component and the moving scroll component; and valve components (90, 90A) arranged in the communication channel (73) are formed to respond the pressure difference between the compression cavity and the back pressure cavity so as to provide a first aperture and a second aperture, and the second aperture is smaller than the first aperture.

16 Claims, 9 Drawing Sheets

(51) Int. Cl.
*F04C 27/00* (2006.01)
*F04C 28/24* (2006.01)

(58) Field of Classification Search
USPC ..... 418/55.1
See application file for complete search history.

(56) References Cited

FOREIGN PATENT DOCUMENTS

| | | | |
|---|---|---|---|
| CN | 102042224 | A | 5/2011 |
| CN | 102454603 | A | 5/2012 |
| CN | 202926632 | U | 5/2013 |
| CN | 203404079 | U | 1/2014 |
| JP | S58160583 | A | 9/1983 |
| JP | H0399887 | U | 10/1991 |
| JP | H03222883 | A | 10/1991 |
| JP | 2002349458 | A | 12/2002 |
| JP | 2004011473 | A | 1/2004 |
| JP | 2006299806 | A | 11/2006 |
| JP | 2008280847 | A | 11/2008 |
| KR | 100315792 | B1 | 12/2001 |

OTHER PUBLICATIONS

International Search Report for PCT/CN2014/082316, ISA/CN, Beijing, dated Oct. 15, 2014 (English and Chinese).

Written Opinion of the ISA, ISA/CN, Beijing, dated Oct. 15, 2014 (Chinese).

European Search Report for PCT/CN2014/082316, EPO, Munich, Germany, dated Jun. 14, 2016.

* cited by examiner

SCROLL COMPRESSOR HAVING VALVE COMPONENT ARRANGED IN PASSAGE OF BACK PRESSURE CAVITY AND PROVIDING OPENINGS FOR PASSAGE OF FLUID

This application is the national phase of International Application No. PCT/CN2014/082316 titled "SCROLL COMPRESSOR" and filed on Jul. 16, 2014, which claims the benefits of priorities to Chinese patent applications Nos. 201310342191.5 and 201320481483.2 filed with the Chinese State Intellectual Property Office on Aug. 7, 2013, all three of which are incorporated herein by reference in their entirety.

FIELD

The present application relates to a scroll compressor.

BACKGROUND

The content of this part only provides background information relevant to the present disclosure, and may not constitute the conventional art.

In the field of scroll compressor, a moving scroll component floating design is known. In this design, a fixed scroll component is fixed relative to a housing of a compressor, and a back pressure cavity is provided between the moving scroll component and a main bearing housing, the back pressure cavity is in fluid communication with one of multiple compression pockets formed between the fixed scroll component and the moving scroll component via a communication passage arranged in the moving scroll component to thereby provide the moving scroll component a back pressure for allowing the moving scroll component to be engaged with a fixed scroll component. When the resultant force formed in the compression pockets is greater than the back pressure, the moving scroll component tilts such that the moving scroll component is separated from the fixed scroll component in an axial direction (which is also referred to as the axial compliance), thereby protecting the compressor, especially the scroll components.

However, in this design, sealing of the back pressure cavity is generally achieved by a dynamic contact seal between the moving scroll component and the fixed scroll component. When the moving scroll component tilts, the pressure in the back pressure cavity may leak into parts (for example, compression pockets under suction pressure, located radially outside) of the compression pockets via an area of the dynamic contact seal to thereby cause the reduction of the back pressure, which further deteriorates the dynamic contact sealing between the moving scroll component and the fixed scroll component, and might even cause malfunction of the scroll compression.

Therefore, a scroll compressor with further improved performance is desired.

SUMMARY

An object of one or more embodiments of the present application is to provide a scroll compressor with further improved performance.

In order to achieve the above object, according to an aspect of the present application, a scroll compressor is provided, including: a shell; a fixed scroll component and a moving scroll component provided in the housing, wherein the fixed scroll component is arranged to be fixed relative to the housing, and the moving scroll component is arranged to be able to float in an axial direction relative to the fixed scroll component; a main bearing housing provided in the shell to support the moving scroll component, wherein a back pressure cavity is formed between the moving scroll component and the main bearing housing, the back pressure cavity is in fluid communication with a compression pocket between the fixed scroll component and the moving scroll component via a communication passage formed in the moving scroll component; and a valve component provided in the communication passage, wherein the valve component is configured to provide a first opening and a second opening in response to the pressure difference between the compression pocket and the back pressure cavity, the second opening is smaller than the first opening.

With the description provided herein, other application areas will become evident. It should be understood that the specific examples and embodiments described in this part are only for the purpose of illustration, and not intended to limit the scope of the present disclosure.

BRIEF DESCRIPTION OF THE DRAWINGS

The accompany drawings described in this part are only for the purpose of illustration, and are not intended to limit the scope of the present disclosure in any way.

DETAILED DESCRIPTION

Figure 1:
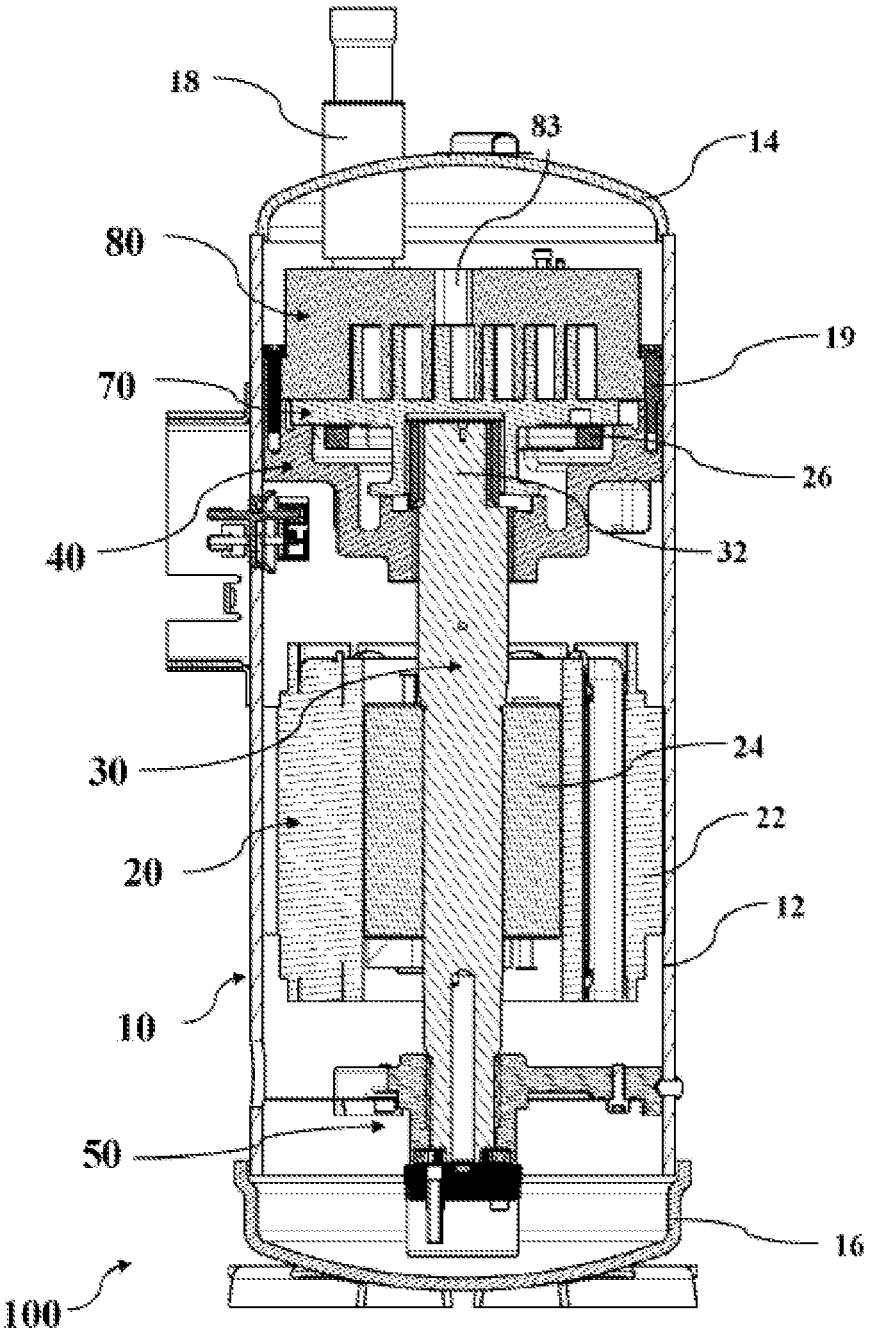
FIG. 1 is a longitudinal sectional view of a scroll compressor.

The following description is only illustrative in nature and not intended to limit the disclosure, application and use. It should be understood that in these accompany drawings, corresponding reference numerals refer to similar or corresponding elements and features.

Hereinafter, the basic construction and principle of a scroll compressor 100 known by the applicator will first be described with reference to FIGS. 1, 2, 3A and 3B.

As shown in FIG. 1, generally, the scroll compressor (hereinafter, it is also referred to as the compressor) 100 may include a shell 10, a compression mechanism arranged in the shell and consisting of a fixed scroll component 80 and a moving scroll component 70, a main bearing housing 40 configured to support the compression mechanism, a driving mechanism constituted of a motor 20 and a rotating shaft 30, etc.

More specifically, the shell 10 generally includes a substantially cylindrical body 12, a top cap 14 arranged on an end of the body 12 and a bottom cap 16 arranged on the other end of the body 12. The shell 10 constitutes a substantially sealed space. On the shell 10, an intake passage 18 configured to suck working fluid (for example, refrigerant) and an exhaust passage (not shown) configured to discharge the compressed working fluid are provided.

The motor 20 consists of a stator 22 fixed relative to the shell 10 and a rotor 24 rotatable relative to the stator 22. The rotor 24 is provided therein with the rotating shaft 30 having an eccentric crank pin 32, to thereby drive the moving scroll component 70 to orbit relative to the fixed scroll component 80 (i.e., a central axis of the moving scroll component 70 rotates around a central axis of the fixed scroll component 80, but the moving scroll component 70 itself does not rotate around its own central axis), thereby achieving the compression of fluid. The orbiting described above is achieved by a Oldham ring 26 arranged between the fixed scroll component 70 and the moving scroll component 80.

An end of the rotating shaft 30 is supported by the main bearing housing 40, and the other end is supported by a lower bearing housing 50. The main bearing housing 40 is generally fixed relative to the shell 10.

Figure 2:
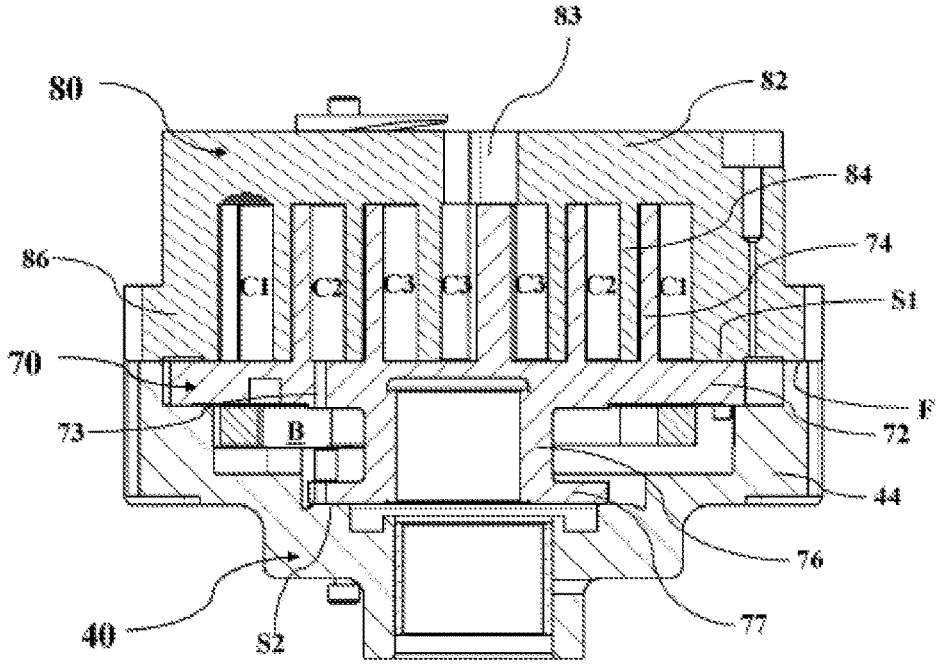
FIG. 2 is a partial enlarged view of FIG. 1.
Figures 3A, 3B:
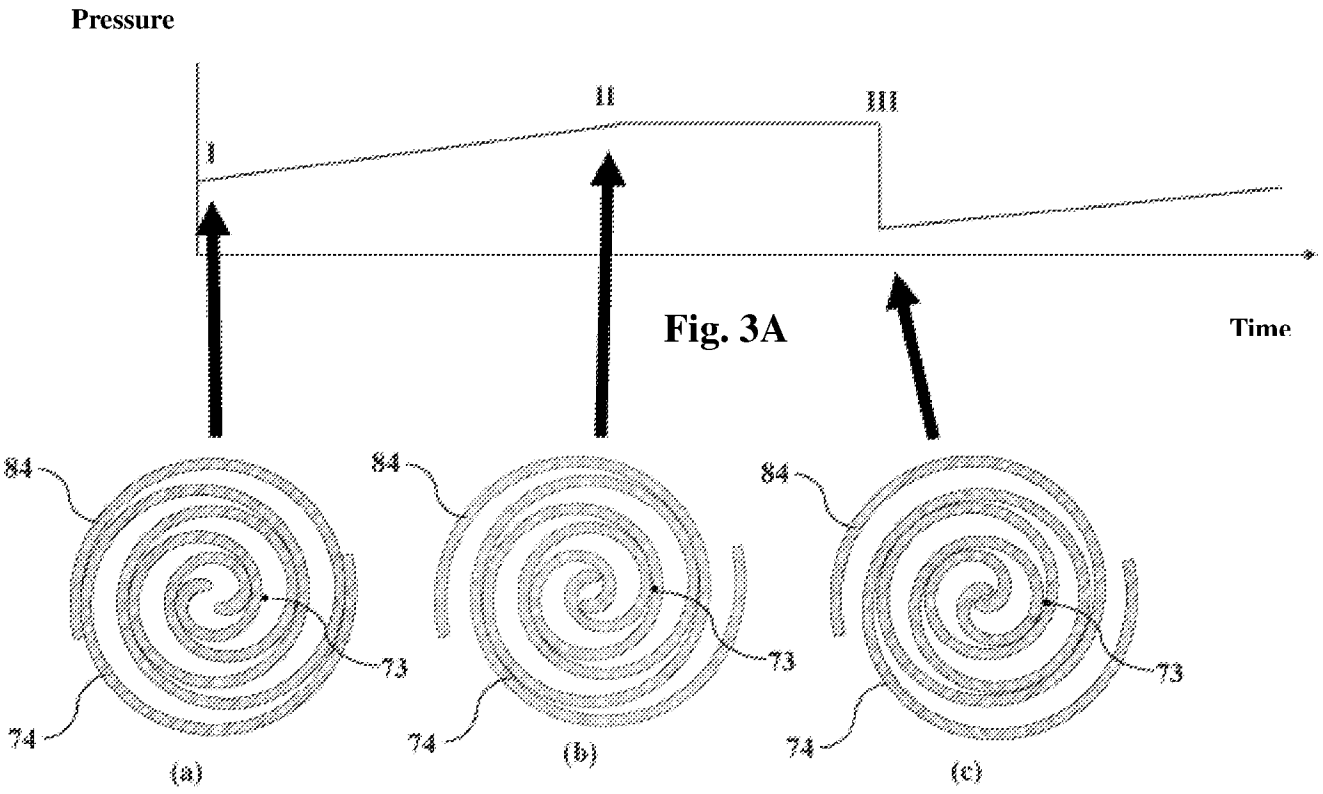
FIG. 3A is a schematic view showing the change of pressure in a back pressure cavity.
FIG. 3B is a schematic view of the change of a compression pocket corresponding to the change of the back pressure in FIG. 3A.

Reference is also made to FIG. 2. The moving scroll component 70 includes an end plate 72, a spiral-shaped vane 74 formed at one side of the end plate, and a hub 76 formed at the other side of the end plate. The fixed scroll component 80 includes an end plate 82, a spiral-shaped vane 84 formed at one side of the end plate, and an exhaust port 83 formed approximately at a center of the end plate. Between the spiral-shape vanes 84 of the fixed scroll component 80 and the spiral-shaped vanes 74 of the moving scroll component 70, a series of compression pockets C1, C2 and C3 having decreasing volume from the outside to the inside in a radial direction are formed. The radially outermost compression pocket C1 is under suction pressure, and the radially innermost compression pocket C3 is under discharge pressure. The middle compression pocket C2 is under a pressure between the suction pressure and the discharge pressure, and thus is referred to as a medium-pressure pocket.

In a so-called high-side design shown in FIG. 1, the intake passage 18 is directly and hermetically connected to the outermost compression pocket (for example the compression pocket C1) of the multiple compression pockets C1, C2 and C3 formed between the fixed scroll component 80 and the moving scroll component 70. The compressed working fluid discharged from the exhaust port 83 of the compression mechanism is filled in the shell 10 and discharged out of the compressor through the exhaust passage.

Furthermore, in the design shown in FIG. 1, the fixed scroll component 80 may be arranged to be fixed relative to the shell 10, and the moving scroll component 70 may be arranged to be able to float in the axial direction relative to the fixed scroll component 80. More specifically, for example, the fixed scroll component 80 may be fixed on the main bearing housing 40 by multiple bolts 19. Furthermore, preferably, the fixed scroll component 80 is fixedly connected to the main bearing housing 40 such that an engagement interface F between them is substantially sealed. The moving scroll component 70 is supported by the main bearing housing 40. More specifically, one side (lower side) of the end plate 72 of the moving scroll component 70 is supported by a part 44 of the main bearing housing 40 such that the moving scroll component 70 is able to move in the axial direction in a predetermined range between a radially outer periphery 86 of the fixed scroll component 80 and the part 44 (i.e., the so-called moving scroll floating design).

In order to make the compression mechanism operate normally, the vane 84 of the fixed scroll component 80 needs to be engaged with the end plate 72 of the moving scroll component 70, and the vane 74 of the moving scroll component 70 needs to be engaged with the end plate 82 of the fixed scroll component 80. The engagement between the fixed scroll component 80 and the moving scroll component 70 is achieved by a back pressure cavity B formed between the moving scroll component 70 and the main bearing housing 40. More specifically, the back pressure cavity B is in fluid communication with one (for example the compression pocket C2) of the multiple compression pockets C1, C2 and C3 formed between the fixed scroll component 80 and the moving scroll component 70 via a communication passage 73 formed in the moving scroll component 70 (for example the end plate 72).

Furthermore, a dynamic contact seal S1 is formed between the end plate 72 of the moving scroll component 70 and the radially outer periphery 86 of the fixed scroll component 80, and a sealing interface S2 is formed between hub 76 of the moving scroll component 70 and the main bearing housing 40. In order to facilitate the formation of the sealing interface S2, an end of the hub 76 may include a flange 77 extending outward radially.

Thereby, the substantially sealed back pressure cavity B is formed. When the compressor 100 operates normally, fluid in the compression pocket C2 flows into the back pressure cavity B through the communication passage 73. A pressure in the back pressure cavity B provides the moving scroll component 70 with an axially upward resultant force. Thus, when the resultant force provided by the back pressure cavity B is greater than a resultant force in the compression pockets C1, C2 and C3, the moving scroll component 70 is engaged with the fixed scroll component to compress the fluid. In some cases. When the resultant force in the compression pockets C1, C2 and C3 is greater than the resultant force provided by the back pressure cavity B, the moving scroll component 70 will tilt such that the moving scroll component 70 is separated from the fixed scroll component 80 in the axial direction to thereby protect the compressor, especially the scroll components (which is also referred to as the axial compliance).

However, as described above, in this design, sealing of the back pressure cavity B is generally achieved by the dynamic contact seal S1 between the moving scroll component 70 and the fixed scroll component 80 and the sealing interface S2 between the moving scroll component 70 and the main bearing housing 40. When the moving scroll component 70 tilts, the pressure in the back pressure cavity B may leak into parts (for example, the compression pocket C1 under suction pressure, located radially outside) of the compression pockets via an area of the dynamic contact seal S1 to thereby cause the reduction of the back pressure, which further deteriorates the dynamic contact sealing between the moving scroll component 70 and the fixed scroll component 80, and might even cause the failure of the scroll compression function.

To this end, it has proposed to improve this condition by increasing a communication area of the communication passage 73. For example, referring to FIGS. 3A and 3B, when the fixed scroll component 80 and the moving scroll component 70 are located in a relative position shown at (a), the pressure in the communication passage 73 at the position corresponds to a pressure I in FIG. 3A. As the moving scroll component 70 orbits, the pressure at the position is gradually increased and reaches to a maximum pressure II at a relative position shown at (b). After the maximum pressure II is maintained for a period of time, there is a great pressure drop III at a relative position shown at (c). With the operation of the compressor, the back pressure provided by the back pressure cavity fluctuates circularly. By increasing the communication area of the communication passage 73, an inflow rate of fluid in the back pressure cavity B is allowed to be greater than a leakage rate of the fluid via the dynamic contact seal S1, and thus a stable pressure may be established more quickly in the back pressure cavity B.

Figure 4:
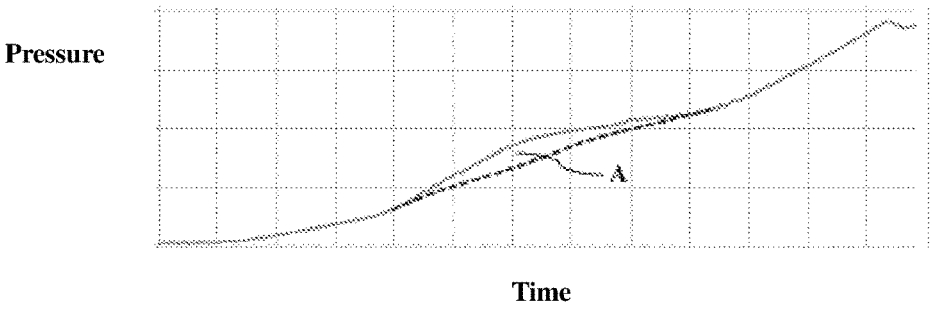
FIG. 4 is a graph showing the influence of a communication area of a communication passage on energy loss.
Figure 5:
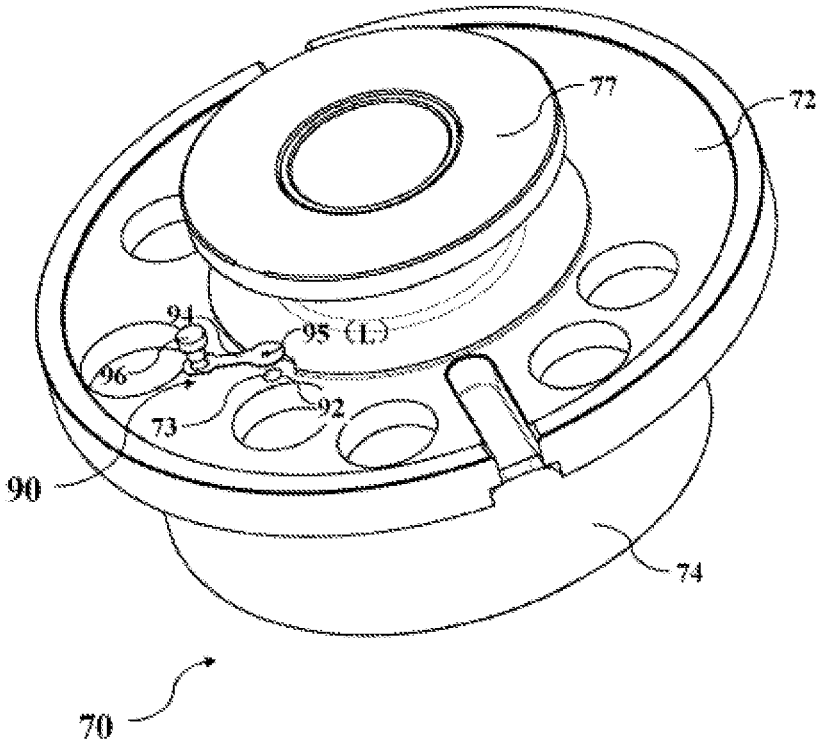
FIG. 5 is a perspective exploded view of a moving scroll component including a valve component according to a first embodiment.
Figure 6:
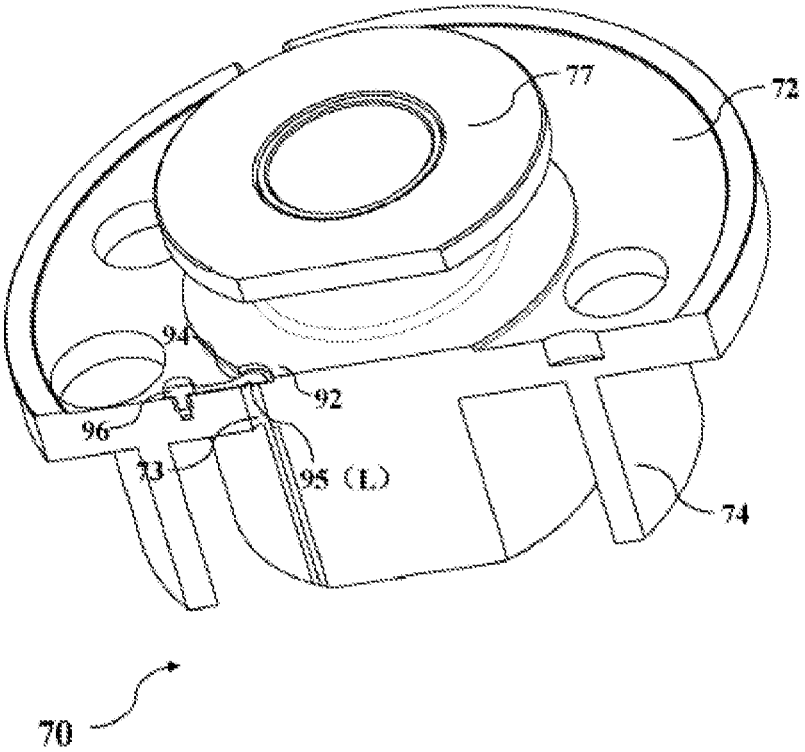
FIG. 6 is a perspective assembly view of the moving scroll component including the valve component according to the first embodiment.
Figure 7:
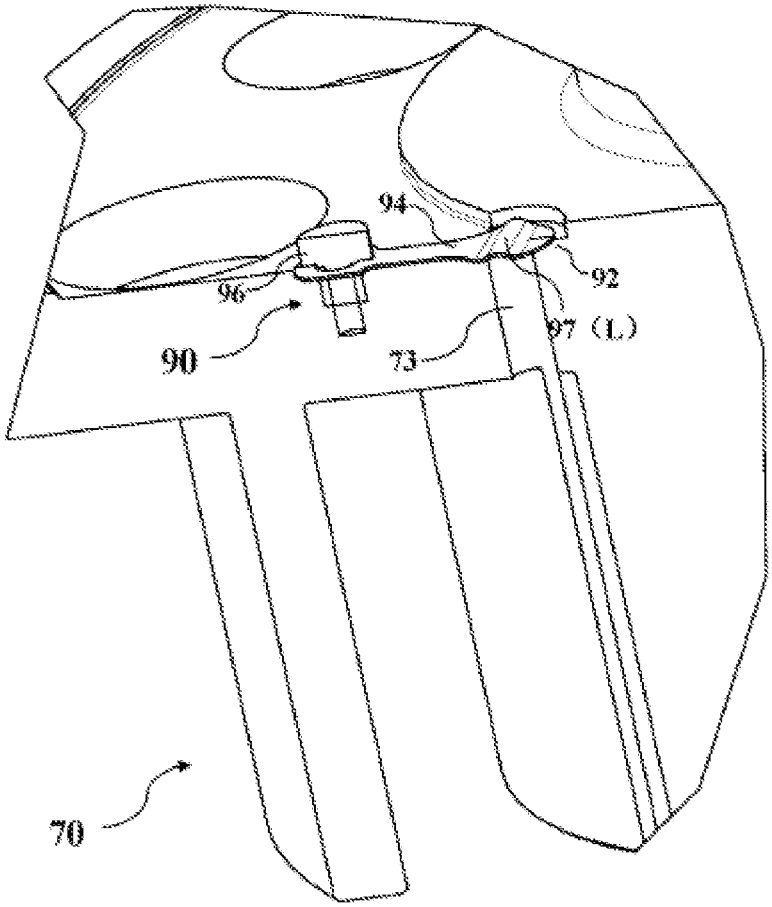
FIG. 7 is a partial perspective assembly view of a valve component according to a first variation of the first embodiment.
Figure 8:
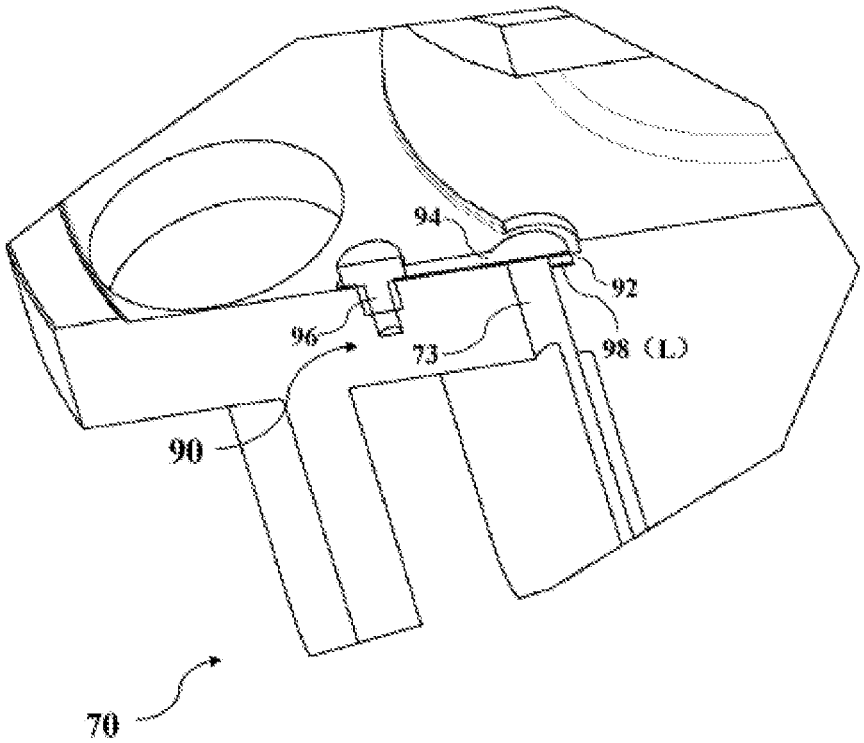
FIG. 8 is a partial perspective assembly view of a valve component according to a second variation of the first embodiment.

However, the inventor found that, compared with a communication passage with a small communication area, the communication passage 73 with a large communication area may cause a reduced overall performance of the compressor. More specifically, reference is made to FIG. 4, in which the horizontal axis shows time and the vertical axis shows a pressure in the compression pocket, the solid line shows a pressure hump formed in the case of a large communication passage 73, and the dotted line shows a pressure hump formed in the case of a small communication passage 73. It can be seen from FIG. 4 that the difference between the communication areas of the communication passage 73 results in an area of energy loss indicated by the sign A.

Based on the above discussion, the inventor of the application provides a solution as follows (reference is made to FIGS. 5 to 9): a valve component 90 is provided in the communication passage 73, the valve component 90 is configured to provide a first opening and a second opening in response to the pressure difference between the compression pocket C2 and the back pressure cavity B, the second opening is smaller than the first opening. More specifically, when the pressure difference between the compression pocket C2 and the back pressure cavity B is greater than or equal to a predetermined value, the valve component 90 provides the first opening. When the pressure difference between the compression pocket C2 and the back pressure cavity B is smaller than the predetermined value, the valve component 90 provides the second opening. Preferably, the second opening may be set to be 1/10 to 1/2 of the first opening.

Although in the conception of the present application, the valve component may be any valve component capable of achieving the above function, such as an electromagnetic valve component or a mechanical valve component. However, in the view of reducing the cost and facilitating installation operation, a mechanical elastic valve component is preferably employed.

FIGS. 5 to 8 show a valve component 90 according to a first embodiment and its variations of the present application. Specifically, the valve component 90 may include a valve seat 92 and an elastic valve flap 94 configured to open or close the valve seat 92. A leakage passage L configured to provide the second opening may be formed in at least one of the valve seat 92 and the valve flap 94. The leakage passage L may be in one of the following forms: a hole 95 or notch formed in the valve flap 94 (see FIG. 5), a groove 98 formed in the valve seat 92 (see FIG. 8), a raised part 97 formed on the valve flap 94 (see FIG. 7), etc.

In the example as shown, the valve seat 92 may be formed of a part of the moving scroll component 70. It should be understood by the skilled person in the art that the valve seat 92 may be a separate component and may be mounted in the communication passage 73. The valve flap 94 may be in the form of a cantilever beam, and one end of the valve flap 94 may be fixed on the moving scroll component 70 via a fastener 96. A passage area of the leakage passage L may be 1/10 to 1/2 of a passage area of the communication passage 73.

In the above first embodiment and its variations, when the pressure difference between the compression pocket C2 and the back pressure cavity B is greater than or equal to a predetermined value (i.e., a back pressure is required to be established quickly and stabilized in the back pressure cavity), the valve flap 94 moves away from the valve seat 92 under the action of the pressure difference to thereby provide the relatively large first opening. When the pressure in the back pressure cavity B becomes substantially stable, the pressure difference between the compression pocket C2 and the back pressure cavity B is smaller than the predetermined value, so that the valve seat 92 is closed by the valve flap 94. However, with presence of the leakage passage L, the valve component 90 still provides the relatively small second opening, so that the high performance of the compressor is maintained.

In particular, the first opening (the communication area of the communication passage 73) may be reasonably set based on the requirement of quickly establishing and stabilizing of a back pressure in the back pressure cavity, and the second opening (the communication area of the leakage passage L) may be reasonably set based on the requirement of optimization of the compressor performance. In addition, the elastic force of the valve flap 94 (i.e., the pressure difference required to move the valve flap 94 away from the valve seat 92) may also be reasonably set based on the requirement of optimization of the compressor performance.

Therefore, according to the configuration of the present application, a back pressure in the back pressure cavity can be established quickly, and the overall performance of the compressor can be improved and the axial compliance of the compression mechanism can be ensured. Also, the configuration of the compressor according to the conception of the present application is still relatively simple and the total cost is not increased greatly.

Figure 9:
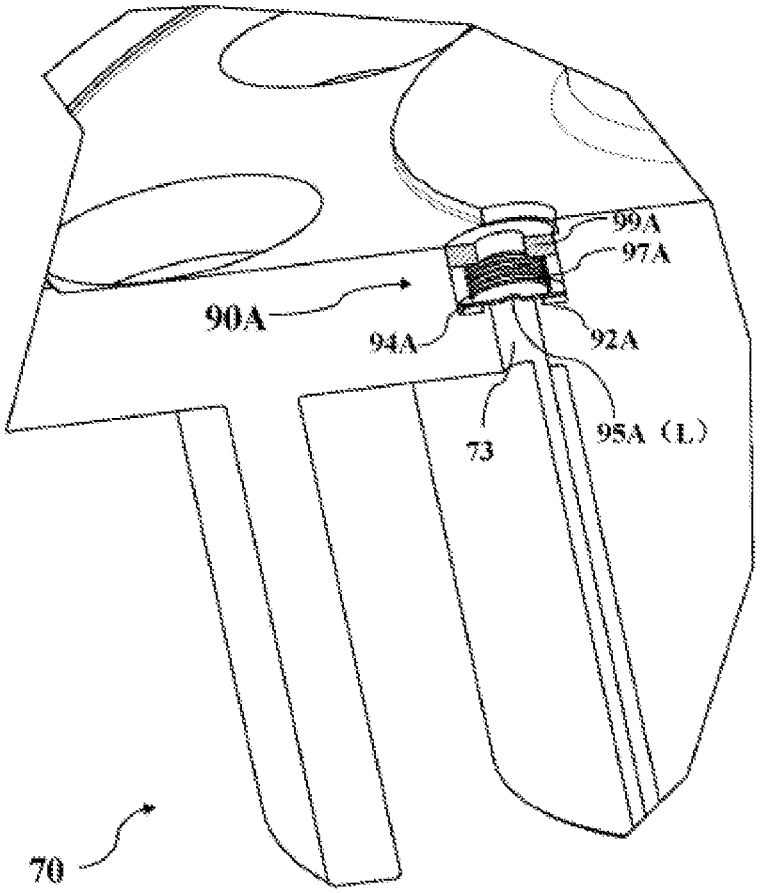
FIG. 9 is a partial perspective assembly view of a valve component according to a second embodiment.

FIG. 9 shows a valve component 90A according to a second embodiment of the present application. the valve component 90A may include a valve seat 92A, a valve flap 94A configured to open or close the valve seat, and a spring 97A configured to apply a spring force to the valve flap. The valve component 90A may further include a retainer (for example, a retaining ring) 99A configured to retain the valve flap 94A and the spring 97A. The retainer 99A may be fitted in the communication passage 73, and the spring 97A may be located between the retainer 99A and the valve flap 94A.

Similarly, a leakage passage L configured to provide the second opening may be formed in at least one of the valve seat 92A and the valve flap 94A. Similar to the first embodiment, the leakage passage L may be in one of the following forms: a hole 95A or notch formed in the valve flap 94A (see FIG. 9), a groove (similar to the groove shown in FIG. 8) formed in the valve seat, a raised part (similar to the raised part shown in FIG. 7) formed on the valve flap, etc.

Similarly, the valve seat 92A may be formed of a part of the moving scroll component 70 or may be formed of a separate component. A passage area of the leakage passage L may be 1/10 to 1/2 of a passage area of the communication passage 73.

The valve component 90A of the second embodiment may be operated in a similar manner to the valve component 90 of the first embodiment, and may achieve a similar effect.

Although the embodiments of the present application have been described with reference to the high-side design of scroll compressor shown in FIG. 1, it should be understood by the skilled person in the art that the present application is applicable in a low-side design. In this case, a suction port of a compression mechanism consisting of a moving scroll component and a fixed scroll component opens into a shell at suction pressure, and a high-pressure fluid discharged from the compression mechanism is discharged into a space isolated from the suction pressure. The configuration of a back pressure cavity may be similar to that shown in FIG. 1, that is, the back pressure cavity may still be formed between the moving scroll component and a main bearing housing. In addition, in a communication passage being in fluid communication with the back pressure cavity, the valve component 90 or 90A as described above with reference to FIGS. 5 to 9 may be provided. When the conception of the present application is applied in the low-side design, the operation and the function of the valve component are the same as those in the above first and second embodiments.

Although several embodiments and aspects of the present application have been described above, it should be understood by the skilled person in the art that further variation and/or improvement can be made to some aspects of the present application.

For example, in some aspects, a scroll compressor may include: a shell; a fixed scroll component and a moving scroll component provided in the shell, wherein the fixed scroll component is arranged to be fixed relative to the shell, and the moving scroll component is arranged to be able to float in an axial direction relative to the fixed scroll component; a main bearing housing provided in the shell to support the moving scroll component, wherein a back pressure cavity is formed between the moving scroll component and the main bearing housing, the back pressure cavity is in fluid communication with a compression pocket formed between the fixed scroll component and the moving scroll component via a communication passage formed in the moving scroll component; and a valve component provided in the communication passage, wherein the valve component is configured to provide a first opening and a second opening in response to the pressure difference between the compression pocket and the back pressure cavity, the second opening being smaller than the first opening.

For example, in some aspects, when the pressure difference between the compression pocket and the back pressure cavity is greater than or equal to a predetermined value, the valve component provides the first opening; when the pressure difference between the compression pocket and the back pressure cavity is smaller than a predetermined value, the valve component provides the second opening.

For example, in some aspects, the second opening is 1/10 to 1/2 of the first opening.

For example, in some aspects, the valve component is an elastic valve component.

For example, in some aspects, the elastic valve component includes a vale seat and an elastic valve flap configured to open or close the valve seat, and a leakage passage configured to provide the second opening is formed in at least one of the valve seat and the valve flap. Preferably, the leakage passage may be in one of the following forms: a hole or notch formed in the valve flap, a groove formed in the valve seat, and a raised part formed on the valve flap. Preferably, the valve seat is formed of a part of the moving scroll component. Preferably, the valve flap is in the form of a cantilever beam, and one end of the valve flap is fixed on the moving scroll component. Preferably, a passage area of the leakage passage is 1/10 to 1/2 of a passage area of the communication passage.

For example, in some aspects, the elastic valve component includes a valve seat, a valve flap configured to open or close the valve seat, and a spring configured to apply a spring force to the valve flap, wherein a leakage passage configured to provide the second opening is formed in at least one of the valve seat and the valve flap. Preferably, the leakage passage is in one of the following forms: a hole or notch formed in the valve flap, a groove formed in the valve seat, and a raised part formed on the valve flap. Preferably, the valve seat is formed of a part of the moving scroll component. Preferably, the scroll compressor further includes a retainer configured to maintain (or hold) the valve flap and the spring. Preferably, a passage area of the leakage passage is 1/10 to 1/2 of a passage area of the communication passage.

For example, in some aspects, a dynamic contact seal is formed between an end plate of the moving scroll component and a radially outer periphery of the fixed scroll component.

For example, in some aspects, a sealing interface is formed between a hub of the moving scroll component and the main bearing housing.

For example, in some aspects, the scroll compressor has a high-side design (high-side scroll compressor).

For example, in some aspects, an intake passage of the compressor is directly and hermetically connected to an outermost compression pocket between the fixed scroll component and the moving scroll component.

For example, in some aspects, the scroll compressor has a low-side design (low-side scroll compressor).

For example, in some aspects, a suction port of a compression mechanism consisting of the moving scroll component and the fixed scroll component opens into the shell.

For example, in some aspects, the fixed scroll component is fixedly connected to the main bearing housing such that an engagement interface between the fixed scroll component and the main bearing housing is substantially sealed.

Although the embodiments of the disclosure have been described in detail herein, it should be understood that the present disclosure is not limited to the specific embodiments described in detail and illustrated herein, and those skilled in the art can also make other variants and modifications without departing from the principle and scope of the disclosure. These variants and modifications should also be deemed to fall into the scope of the disclosure. Furthermore, all the elements, components or features described herein can be replaced by other equivalent elements, components or features in structures and functions.

The invention claimed is:

1. A scroll compressor, comprising:

a shell;

a fixed scroll component and a moving scroll component provided in the shell, wherein the fixed scroll component is arranged to be fixed relative to the shell, and the moving scroll component is arranged to be floatable in an axial direction relative to the fixed scroll component;

a main bearing housing provided in the shell to support the moving scroll component, wherein a back pressure cavity is formed between the moving scroll component and the main bearing housing, and the back pressure cavity is in fluid communication with a compression pocket formed between the fixed scroll component and the moving scroll component via a communication passage formed in the moving scroll component;

wherein the scroll compressor further comprises a valve component provided in the communication passage, the valve component comprises a valve seat and a valve flap, the valve flap is at least partially movable away from the valve seat in response to the pressure difference between the compression pocket and the back pressure cavity to form a first opening, a second opening is in form of a leakage passage provided in at least one of the valve seat and the valve flap, and the second opening is smaller than the first opening, wherein when the pressure difference between the compressor pocket and the back pressure cavity is equal to or greater than a predetermined value, the valve component allows fluid to flow from the compression pocket into the back pressure cavity via the first opening at a first flow rate, and when the pressure difference between the compressor pocket and the back pressure cavity is smaller than the predetermined value, the valve component allows fluid to flow from the compression pocket into the back pressure cavity via the second opening at a second flow rate, the first flow rate is greater than the second flow rate.

2. The scroll compressor according to claim 1, wherein the second opening is 1/10 to 1/2 of the first opening.

3. The scroll compressor according to claim 1, wherein the valve component is an elastic valve component.

4. The scroll compressor according to claim 3, wherein the valve flap is an elastic valve flap configured to open or close the valve seat.

5. The scroll compressor according to claim 1, wherein the leakage passage is in one of the following forms: a hole or notch formed in the valve flap, a groove formed in the valve seat, and a raised part formed on the valve flap.

6. The scroll compressor according to claim 1, wherein the valve seat is formed of a part of the moving scroll component.

7. The scroll compressor according to claim 1, wherein a passage area of the leakage passage is 1/10 to 1/2 of a passage area of the communication passage.

8. The scroll compressor according to claim 3, wherein the elastic valve component further comprises a spring configured to apply a spring force to the valve flap.

9. The scroll compressor according to claim 8, further comprising a retainer configured to retain the valve flap and the spring.

10. The scroll compressor according to claim 1, wherein a dynamic contact seal is formed between an end plate of the moving scroll component and a radially outer periphery of the fixed scroll component.

11. The scroll compressor according to claim 1, wherein a sealing interface is formed between a hub of the moving scroll component and the main bearing housing.

12. The scroll compressor according to claim 1, wherein the scroll compressor is of a high-side design.

13. The scroll compressor according to claim 12, wherein an intake passage of the scroll compressor is directly and hermetically connected to an outermost compression pocket between the fixed scroll component and the moving scroll component.

14. The scroll compressor according to claim 1, wherein the scroll compressor is of a low-side design.

15. The scroll compressor according to claim 14, wherein a suction port of a compression mechanism consisting of the moving scroll component and the fixed scroll component opens into the shell.

16. The scroll compressor according to claim 1, wherein the fixed scroll component is fixedly connected to the main bearing housing such that an engagement interface between the fixed scroll component and the main bearing housing is substantially sealed.

* * * * *